US009267395B2

(12) United States Patent
Nendel

(10) Patent No.: US 9,267,395 B2
(45) Date of Patent: Feb. 23, 2016

(54) SLIDING CAM SYSTEM OF A RECIPROCATING PISTON INTERNAL COMBUSTION ENGINE WITH SLIDING GROOVES AND GUIDE ELEMENTS ARRANGED IN AN X-SHAPE

(71) Applicant: Schaeffler Technologies GmbH & Co. KG, Herzogenaurach (DE)

(72) Inventor: Andreas Nendel, Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/408,446

(22) PCT Filed: Apr. 26, 2013

(86) PCT No.: PCT/EP2013/058679
§ 371 (c)(1),
(2) Date: Dec. 16, 2014

(87) PCT Pub. No.: WO2013/189644
PCT Pub. Date: Dec. 27, 2013

(65) Prior Publication Data

US 2015/0184554 A1 Jul. 2, 2015

(30) Foreign Application Priority Data

Jun. 18, 2012 (DE) ..... 10 2012 210 212

(51) Int. Cl.
*F01L 1/34* (2006.01)
*F01L 1/04* (2006.01)
*F01L 13/00* (2006.01)

(52) U.S. Cl.
CPC . *F01L 1/044* (2013.01); *F01L 1/34* (2013.01); *F01L 13/0036* (2013.01); *F01L 2013/0052* (2013.01)

(58) Field of Classification Search
CPC ..... F01L 1/044; F01L 1/34; F01L 13/0036; F01L 2013/0052
USPC ..... 123/90.15, 90.17
See application file for complete search history.

(56) References Cited

U.S. PATENT DOCUMENTS

2010/0126445 A1* 5/2010 Schiepp ..... F01L 1/053 123/90.16

FOREIGN PATENT DOCUMENTS

DE 102008024911 11/2009
DE 102009007819 8/2010

*Primary Examiner* — Zelalem Eshete
(74) *Attorney, Agent, or Firm* — Volpe and Koenig, P.C.

(57) ABSTRACT

A reciprocating piston internal combustion engine having at least one camshaft with at least one sliding cam element with sliding cams and sliding grooves (2 and 2*a*) intersecting in an X-shape, wherein the sliding cam element with internal teeth (4) is mounted for conjoint rotation but axially movably on a toothed shaft (5), and wherein a guide element is fixed between the sliding grooves (2 and 2*a*), which guide element has elastically movable switch blades (10 and 10*a*) that are guided on a rotary joint plate (12) mounted in the intersection area. The engine further has an actuator device with at least one actuator pin (9) movable out of a housing, wherein the actuator device can be mounted on a component of a cylinder head or on the cylinder head of the reciprocating piston internal combustion engine, and, after having moved out, the actuator pin (9) comes into connection with at least one sliding groove (2 or 2*a*) of the sliding cam element, said guide element being constructed as a C-shaped spring (6) and fixed, at least at the ends thereof, on the toothed shaft (5).

9 Claims, 5 Drawing Sheets

SLIDING CAM SYSTEM OF A RECIPROCATING PISTON INTERNAL COMBUSTION ENGINE WITH SLIDING GROOVES AND GUIDE ELEMENTS ARRANGED IN AN X-SHAPE

FIELD OF THE INVENTION

The invention relates to a reciprocating piston internal combustion engine comprising at least one camshaft with at least one sliding cam element with sliding cams and sliding grooves intersecting in an X-shape, wherein the sliding cam element with inner teeth is locked in rotation on a toothed shaft but can move in the axial direction, and wherein a guide element is fixed between the sliding grooves, said guide element has elastically movable switch blades that are guided on a rotary joint plate mounted in the intersection area, and comprising an actuator device with at least one actuator pin that can be moved out of a housing, wherein the actuator device can be mounted on a component of a cylinder head or on the cylinder head of the reciprocating piston internal combustion engine, and, after having moved out, the actuator pin connects to at least one sliding groove of the sliding cam element.

BACKGROUND

Such a sliding cam system with guide element is known from DE 10 2008 024 911 A1. In this sliding cam element, the guide element is formed as a nearly circular ring that is linked to a rotary joint plate with the ends of the switch blades. On its side turned away from the rotary joint plate, the guide element has an inward directed extension with which it is inserted into a groove in the sliding cam base.

In this guide element, there is the problem that it must be spread apart very far in order to be able to be pushed over the groove or the base circle of the sliding grooves with the free ends of the switch blades, so that there is the risk of plastic deformation of the guide element. In addition, the guide element is inserted in the groove in the sliding groove base on only one small part of the inner periphery, so that the free switch blades have a very elongated construction, whereby the guiding force while displacing the sliding cam elements is reduced. Even if the ends of the switch blades are supported on the flanks of the X-shaped intersection area, there is the risk that these bend in an impermissible manner on the free sections in front of this support.

SUMMARY

The object of the invention is therefore to design and improve the sliding cam element and the guide element so that the described disadvantages are avoided and continuous displacement of the sliding cam elements over the sliding grooves or the switch blades is possible, without putting at risk the exact displacement of the sliding elements and damaging the guide element or the switch blades. This is to be realized with simple economical means.

The objective of the invention is met in that the guide element is formed as a C-shaped spring and is fixed on the toothed shaft at least with its ends. Through this construction of the guide element it is achieved that the C-shaped spring does not absolutely have to be bent to be fixed to the toothed shaft. The C-shaped spring, also called C-spring below, is inserted into a recess in the sliding groove base between the sliding grooves, so that, after sliding the sliding cam element onto the toothed shaft, the C-spring is held by means of the inner teeth formed on the ends on the C-spring. The C-spring is therefore fixed independent of the sliding cam element on the toothed shaft. The recess in the sliding groove base of the sliding cam element is here formed essentially up to the axis of the sliding cam element or the center of the toothed shaft, so that the C-spring that encloses an angle of approximately 180° is provided with inner teeth on its entire inner surface.

It is further proposed that the C-spring has an inner closed arc and an outer broken arc for forming the switch blades. In this way, the C-shaped spring is held securely in the recess, because the inner arc is arranged in the recess. The circumferential inner arc makes it possible to define the switch blades at an arbitrary point on the inner arc and thus to arbitrarily set the spring stiffness and the elasticity of the switch blades.

The break in the outer arc or the distance between the ends of the switch blades can be realized by a radial separating cut, wherein the ends of the switch blades can abut the outer flanks of the sliding grooves in the intersection area. To make this a transitionless shape, the free ends of the switch blades have side bevels.

In another construction of the invention it is proposed that the recess expands in the direction of the intersection area on both sides of this recess. This extension can be realized, viewed in the circumferential direction, from the beginning of the recess, but it can also be formed at a later point. The flanks of the extension are adapted to the deflection path of the switch blades, so that the switch blades are constantly supported in the direction toward the intersection area, can receive high forces, and guarantee an exact guidance for the actuator pin along the path. This considerably increases the fatigue strength. The stiffness of the support of the actuator pin is also significantly improved. Finally, the guide element and especially the switch blades can also have a thinner construction, so that their durability also increases. In particular, if the switch blades are sufficiently thin, the side bevels at the free ends of the switch blades can be eliminated.

If, as further proposed, the extensions from the sliding groove base are formed narrowing diagonally or at a right angle to the toothed shaft axis in the radial direction up to the inner teeth of the sliding cam element, then the inner arc of the C-spring is also guided elastically along the extensions, so that the transition between the inner arc and the switch blades is loaded less and thus the bending fatigue strength is improved.

The switch blades can have a mono-stable design so that they are set back into the center of the X-shaped intersection of the sliding grooves after passage of the actuator pin through the intersection area.

The switch blades, however, could also have a bi-stable design so that they remain in this pivoted position after passage of the actuator pin and advantageously contact the flanks of the sliding grooves with their ends. The bi-stability can be realized through suitable shaping of the switch blades, e.g., through crimping or stamping, through multi-layer materials, or through a tangential biasing of the switch blades, in particular, the projections in the direction toward the rotary joint plate. The projections are supported in the openings of the rotary joint plate, so that the compressive force on the openings causes a rotation of the rotary joint plate and thus a deflection of the switch blades from the mono-stable position into bi-stable positions.

BRIEF DESCRIPTION OF THE DRAWINGS

For further explanation of the invention, reference will be made to the drawings that show embodiments of the invention in simplified form.

Shown are.

DETAILED DESCRIPTION OF THE PREFERRED EMBODIMENTS

Figure 1:
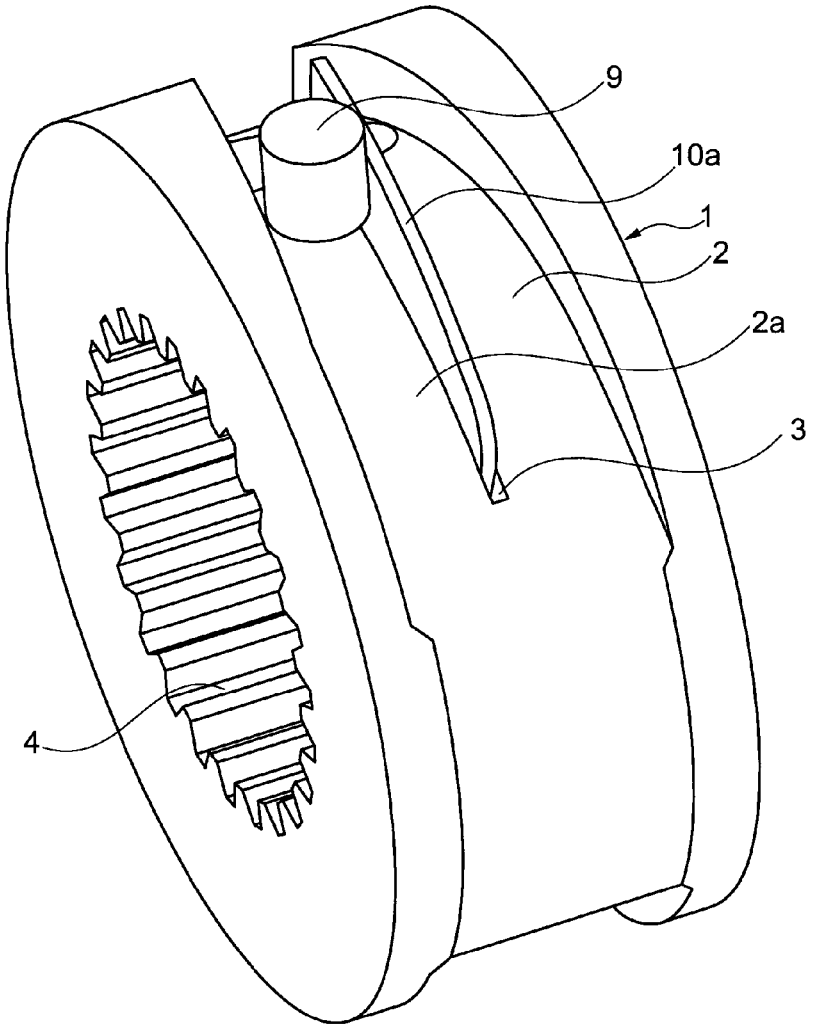
FIG. 1: a perspective view of a sliding groove area of a sliding groove element with actuator pin.
Figure 12:
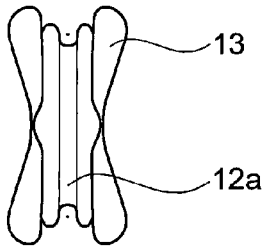
FIG. 12: a top view of the rotary joint opening according to FIG. 11 with rotary joint plate.

In FIGS. 1 and 12, as far as is shown in detail, 1 designates in general a sliding groove area in which two X-shaped, intersecting sliding grooves 2 and 2*a* are formed. The sliding groove area 1 can be constructed as a separate slotted shifting disk that is connected to the sliding cam element, but it could also form one unit with the sliding cam element, so that the sliding cam and the sliding groove area are arranged next to each other.

Figure 3:
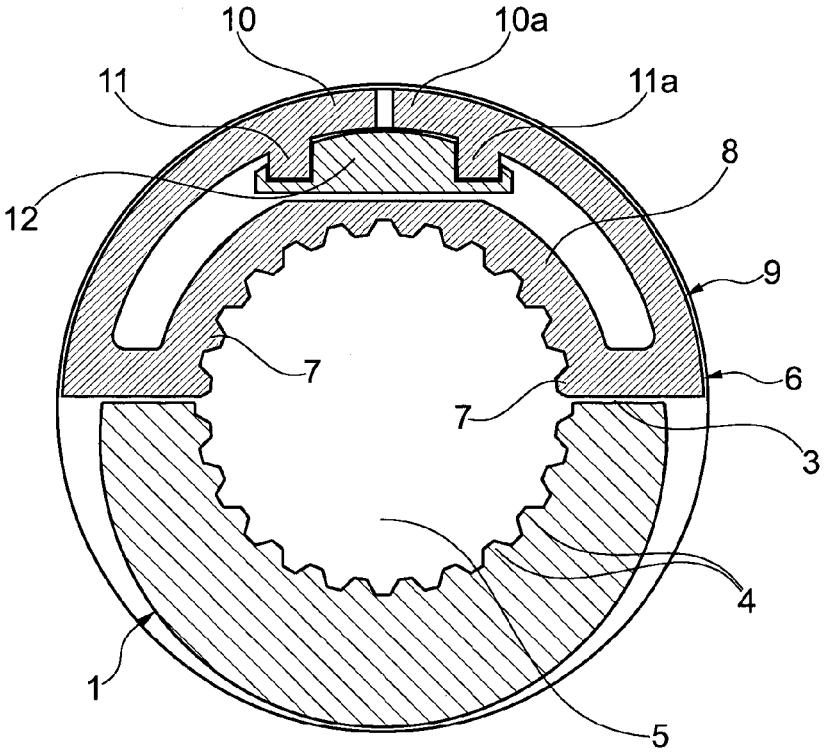
FIG. 3: a section corresponding to FIG. 2 in which the C-spring is inserted into a recess of a sliding cam element.

In the sliding groove area 1 and indeed in the sliding groove base of the sliding grooves 2 and 2*a*, a recess 3 is formed that, as can be seen especially in FIG. 3, extends up to the center axis of the sliding cam element. The sliding cam element has, on the inner opening, inner teeth 4 that mesh with a toothed shaft 5. In the recess 3 according to FIG. 3, a C-shaped spring 6, also called C-spring, is inserted. The C-spring 6 has inner teeth 7 that correspond to the inner teeth 4 on the sliding cam element and also mesh in the toothed shaft 5 so that a large number of inner teeth 7 provide radial clamping of the C-spring on the toothed shaft 5. The C-spring 6 has an inner arc 8 that has a closed design and an outer broken arc 9 that forms the switch blades 10 and 10*a* that are attached to the ends of the inner arc 8 and have, at their free ends, bevels 14, 14*a* for better contact on the flanks of the sliding grooves 2, 2*a* in the intersection area.

Figure 2:
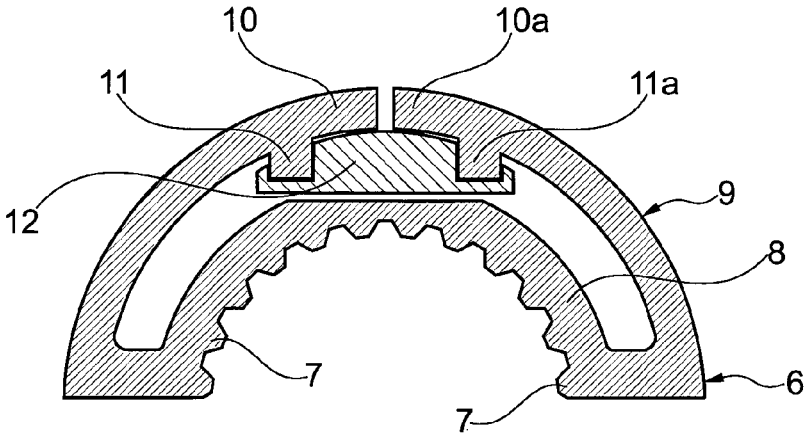
FIG. 2: a section through a C-shaped spring and a rotary joint plate.

The inner arc 8 projects so far into the recess 3 that it is guided in the recess in the axial direction toward the sliding cam element. The switch blades 10 and 10*a* have, in the area of their ends, inwardly directed projections 11 and 11*a* that fit into openings of a rotary joint plate 12, so that the two switch blades 10 and 10*a* are guided against each other by means of the rotary joint plate 12. The rotary joint plate 12 is, as can be seen in FIGS. 1 to 3, fit in a recess in the sliding groove base in the intersection area of the sliding grooves 2 and 2*a* and guided there.

Now, if an actuator pin 9 moves, as shown in FIG. 1, in one of the sliding grooves 2 or 2*a* and approaches the intersection area, then one of the switch blades 10 or 10*a* is pushed and the other switch blade pivots in the other direction by means of the rotary joint plate 12, so that the actuator pin 9 can switch from one sliding groove into the other, guided by the switch blades 10 and 10*a*.

Figure 4:
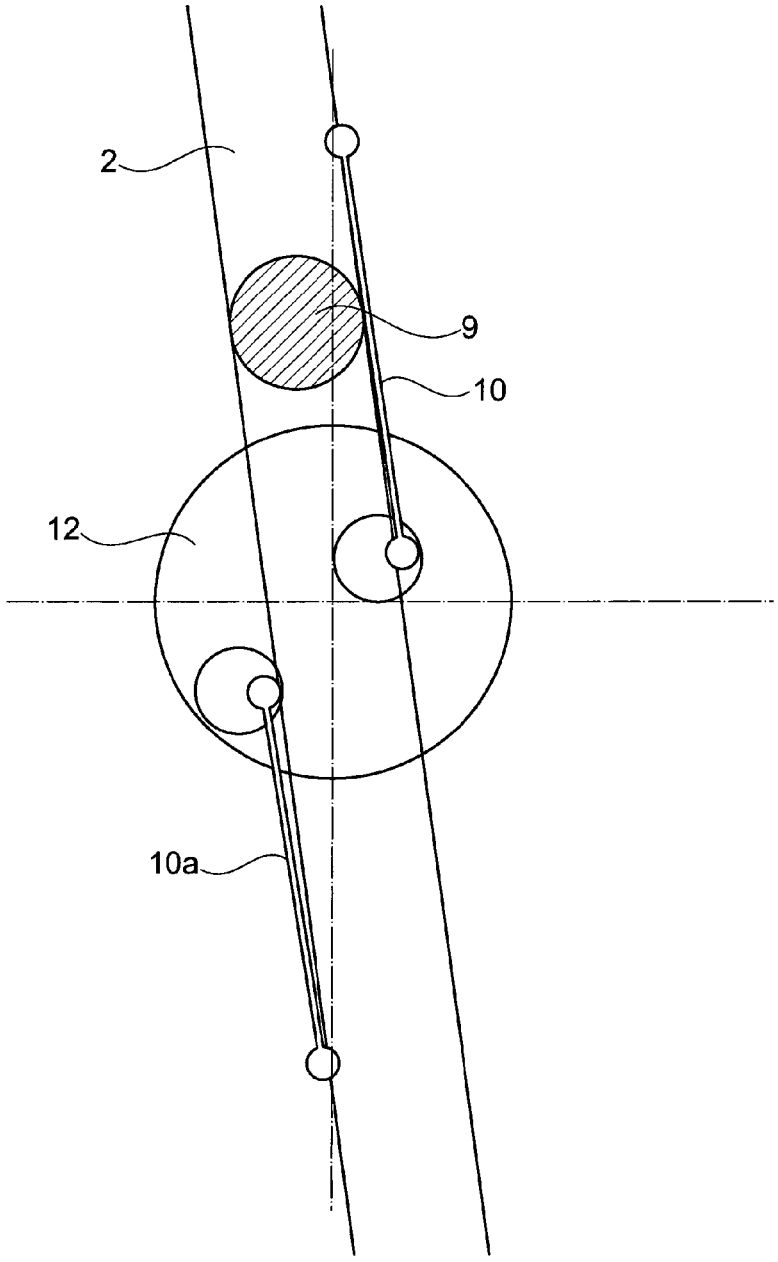
FIG. 4: a schematic top view of the ends of the switch blades with rotary joint plate and modified switching.
Figure 5:
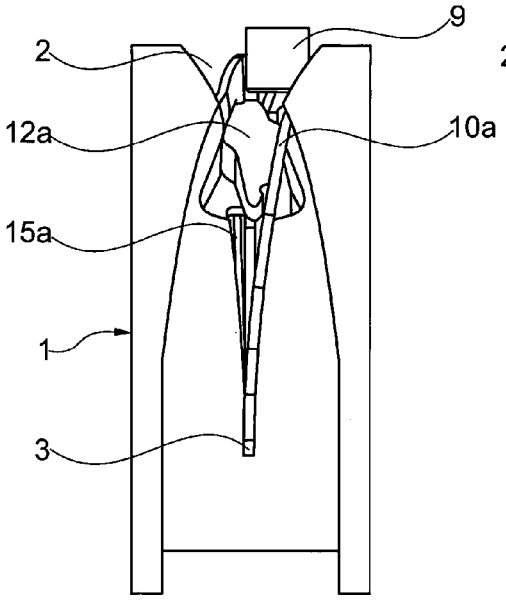
FIG. 5: a side view of a sliding cam area with extensions on the recess.

As can be seen especially in FIG. 4, the switching of the openings in the rotary joint plate 12 can be varied to compensate for deviations in the movement of the ends of the switch blades 10 and 10*a* that can be produced by clearances in the transfer of the movement from one switch blade to the other.

Figure 6:
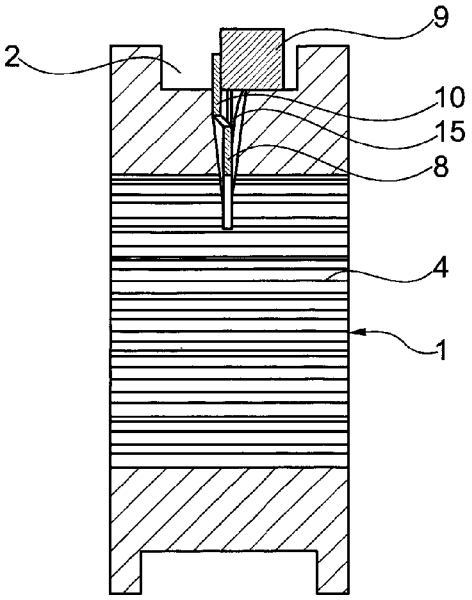
FIG. 6: a section through the sliding cam area of a sliding cam element according to FIG. 5, FIG. 7: a side view similar to FIG. 5 in a different rotational position.
Figure 7:
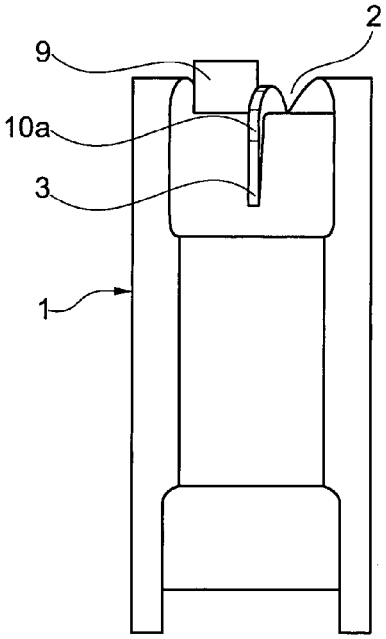
Figure 8:
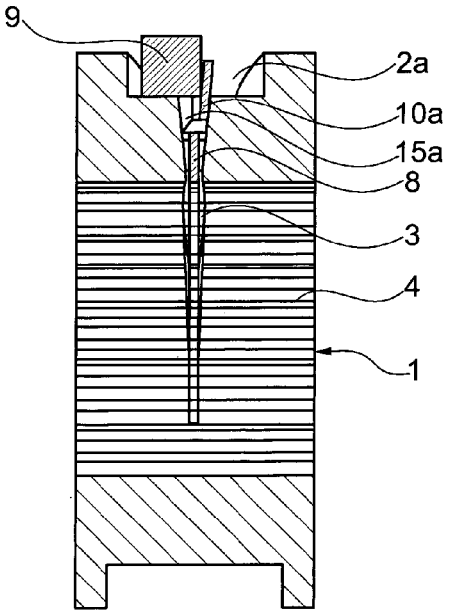
FIG. 8: a section through the sliding cam area according to FIG. 7, FIG. 9: a side view of a sliding cam area of a sliding cam element with extensions in the recess.
Figure 9:
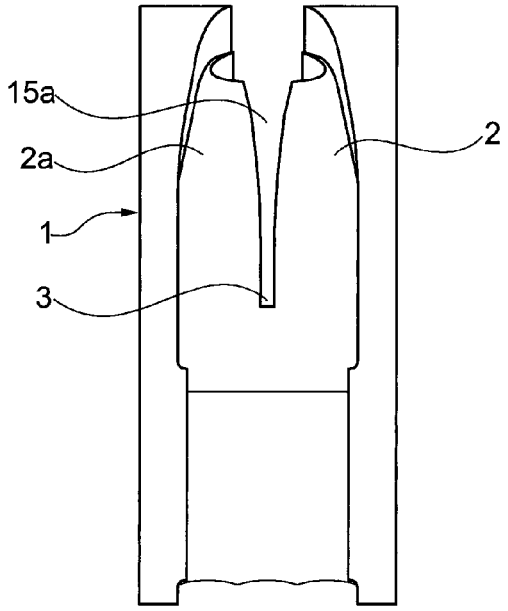
Figure 10:
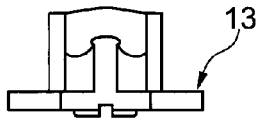
FIG. 10: a view of a rotary joint insert.
Figure 11:
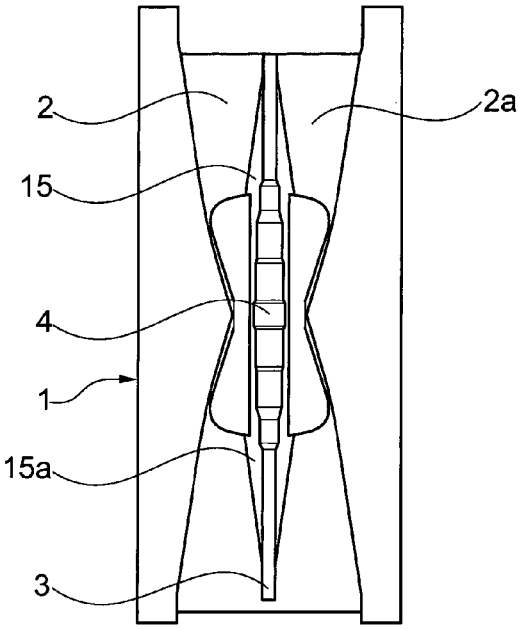
FIG. 11: a top view of the intersection area of a sliding cam element.

In another construction of the invention it is proposed that the recess 3 expands in the direction of the intersection area on both sides of this recess, wherein the extensions 15 and 15*a* can begin at the beginning of the recess 3, but also, viewed in the circumferential direction, at a later time. The switch blades 10 and 10*a* are arranged so that they project into the extensions 15, 15*a*, so that they experience successive support in the extensions according to the shape of the flanks of the extensions 15, 15*a*. In this way, the support force of the switch blades 10, 10*a* is significantly improved relative to the actuator pin 9, wherein the flanks of the extensions 15, 15*a* are designed so that a constantly jolt-free support of the switch blades 10, 10*a* is realized up to their support on the end on the flanks of the sliding grooves 2, 2*a*. It would be sufficient to attach the extensions only on the outside in the radial direction in the area of the switch blades, because this depends on the support of the switch blades 10, 10*a*. The extensions, however, can also be attached from the outside inward in the radial direction so that they are at a right angle to the axis of the sliding cam element. They can also be constructed, as shown in FIGS. 6 and 8, narrowing inward at an angle, so that wedge-shaped flanks are produced on the extensions 15, 15*a*. Therefore, lateral play in the recess 3 is also produced in the region of the inner arc 8, so that a bending path on the inner arc 8 is produced and thus the elasticity of the switch blades 10 and 10*a* is increased.

Because a deeper cutout is produced by the extensions 15, 15*a* of the recess 3 in the intersection area, a rotary joint insert 13 is inserted there that guides a rotary joint plate 12*a* contacting the rotary joint insert 13 on the outside in the radial direction. The rotary joint insert 13 can be eliminated if the V-shaped slot width of the extensions 15, 15*a* is very tapered so that sufficient support is possible for the rotary joint plate.

LIST OF REFERENCE NUMBERS

1 Sliding groove area
2, 2*a* Sliding grooves
3 Recess
4 Inner teeth
5 Toothed shaft
6 C-spring
7 Inner teeth
8 Inner arc
9 Actuator pin
10, 10*a* Switch blades
11, 11*a* Projections
12, 12*a* Rotary joint plates
13 Rotary joint insert
14, 14*a* Bevels
15, 15*a* Extensions

The invention claimed is:

1. A reciprocating piston internal combustion engine comprising at least one camshaft with at least one sliding cam element with sliding cams and sliding grooves intersecting in an X-shape, the sliding cam element includes inner teeth locked in rotation on a toothed shaft and is movable in an axial direction, a guide element is fixed between the sliding grooves, said guide element has elastically movable switch blades that are guided on a rotary joint plate mounted in an intersection area, and an actuator device with at least one actuator pin that is movable out of a housing, the actuator device is mountable on a component of a cylinder head or on the cylinder head of the reciprocating piston internal combustion engine, and, after having moved out, the actuator pin connects to the at least one sliding groove of the sliding cam element, said guide element is constructed as a C-shaped spring and fixed, at least at ends thereof, on the toothed shaft.

2. The reciprocating piston internal combustion engine according to claim 1, wherein a recess is formed between the sliding grooves, said recess extending essentially up to a center of the sliding cam element or the toothed shaft.

3. The reciprocating piston internal combustion engine according to claim 1, wherein the C-shaped spring has, at least at the ends thereof, inner teeth that engage in teeth of the toothed shaft.

4. The reciprocating piston internal combustion engine according to claim 2, wherein the C-shaped spring has an inner closed arc and an outer broken arc for forming the switch blades.

5. The reciprocating piston internal combustion engine according to claim 4, wherein the inner closed arc extends into the recess and is guided there in the axial direction of the sliding cam element.

6. The reciprocating piston internal combustion engine according to claim 2, wherein the recess extends in a direction toward the intersection area on both sides of said recess and the switch blades extend in a radial direction at least partially into extensions.

7. The reciprocating piston internal combustion engine according to claim 6, wherein flanks of the extensions along a deflection path of the switch blades are designed so that a jolt-free support of the switch blades on the actuator pin is provided.

8. The reciprocating piston internal combustion engine according to claim 1, wherein the switch blades have a bistable design by their shape or material selection or their support, and contact flanks of the sliding grooves in the intersection area in rest positions thereof.

9. The reciprocating piston internal combustion engine according to claim 1, wherein a switching ratio of the switch blades to the rotary joint plate is variable.

* * * * *